US007922356B2

(12) United States Patent
Maxik et al.

(10) Patent No.: US 7,922,356 B2
(45) Date of Patent: Apr. 12, 2011

(54) ILLUMINATION APPARATUS FOR CONDUCTING AND DISSIPATING HEAT FROM A LIGHT SOURCE

(75) Inventors: Fredric S. Maxik, Indialantic, FL (US); Addy S. Widjaja, Palm Bay, FL (US); Wei Sun, Melbourne, FL (US); David Henderson, Granville, OH (US)

(73) Assignee: Lighting Science Group Corporation, Westhampton, NJ (US)

( * ) Notice: Subject to any disclaimer, the term of this patent is extended or adjusted under 35 U.S.C. 154(b) by 303 days.

(21) Appl. No.: 12/183,501

(22) Filed: Jul. 31, 2008

(65) Prior Publication Data

US 2010/0027258 A1 Feb. 4, 2010

(51) Int. Cl.
*F21S 4/00* (2006.01)
*F21V 29/00* (2006.01)

(52) U.S. Cl. ..... 362/249.06; 362/249.02; 362/294; 362/373

(58) Field of Classification Search ..... 362/249.02, 362/294, 373, 240, 249.06
See application file for complete search history.

(56) References Cited

U.S. PATENT DOCUMENTS

| | | | | |
|---|---|---|---|---|
| 5,688,042 | A * | 11/1997 | Madadi et al. | 362/240 |
| 6,220,722 | B1 | 4/2001 | Begemann | |
| 6,525,668 | B1 * | 2/2003 | Petrick | 340/815.45 |
| 6,598,996 | B1 | 7/2003 | Lodhie | |
| 6,621,222 | B1 * | 9/2003 | Hong | 315/51 |
| 6,659,632 | B2 * | 12/2003 | Chen | 362/545 |
| 6,682,211 | B2 | 1/2004 | English et al. | |
| 6,715,900 | B2 * | 4/2004 | Zhang | 362/294 |
| 6,787,999 | B2 | 9/2004 | Stimac et al. | |
| 6,796,698 | B2 | 9/2004 | Sommers et al. | |
| 6,864,513 | B2 | 3/2005 | Lin et al. | |
| 6,948,829 | B2 | 9/2005 | Verdes et al. | |
| 6,982,518 | B2 | 1/2006 | Chou et al. | |
| 7,226,189 | B2 | 6/2007 | Lee et al. | |
| 7,344,279 | B2 | 3/2008 | Meuller et al. | |
| 7,585,090 | B2 * | 9/2009 | Wu | 362/249.02 |
| 7,726,836 | B2 * | 6/2010 | Chen | 362/249.02 |
| 2005/0047170 | A1 | 3/2005 | Hilburger et al. | |
| 2006/0050514 | A1 | 3/2006 | Opolka | |
| 2006/0061997 | A1 | 3/2006 | Lin | |
| 2007/0159828 | A1 | 7/2007 | Wang | |
| 2008/0007955 | A1 | 1/2008 | Li | |
| 2008/0055909 | A1 | 3/2008 | Li | |
| 2008/0062703 | A1 | 3/2008 | Cao | |

OTHER PUBLICATIONS

European Search Report for Application No. EP 09 16 5821; Date of completion of the search: Aug. 20, 2009.

* cited by examiner

*Primary Examiner* — Stephen F Husar
*Assistant Examiner* — James W Cranson
(74) *Attorney, Agent, or Firm* — Cantor Colburn LLP

(57) ABSTRACT

An illumination apparatus comprising an optics module wherein a driving circuit may be disposed within the proximal base portion of the optics module. The proximal base portion may further be releasably secured within an independent heat dissipating element. Such an apparatus may be very beneficial in light emitting diode (LED) applications due to its efficient conduction and dissipation of heat away from the LED semiconductor junction. Additionally, a releasable optics module comprising a plurality of LEDs and a driving circuit provides for cost efficient and environmentally friendly replacement of such a component at the end of its lifespan. The heat dissipating element (e.g. heat sink) may continue to be used, while only the optics module need be replaced or serviced as required. Precious environmental resources may thus be conserved and maintenance costs reduced while concurrently extending the lifespan of such an inventive illumination apparatus.

19 Claims, 6 Drawing Sheets

ILLUMINATION APPARATUS FOR CONDUCTING AND DISSIPATING HEAT FROM A LIGHT SOURCE

CROSS REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention generally relates to conducting and dissipating heat from a light source, more particularly to effectively dissipating heat from a light source via a heat conducting element and an independent heat dissipating element further allowing for economical replacement of an optics module at the end of the lifespan of the light source disposed within the optics module.

2. Background Art

Over the past century, a variety of different types of light bulbs and other light sources have been developed. The most common type of light source is the incandescent light bulb, in which electric current is passed through a metal filament disposed in a vacuum, causing the filament to glow and emit light. Another common type of light bulb is the fluorescent light.

The main problem with the standard light bulbs having resistive heating elements (e.g. tungsten) is that such a light source expends more energy as heat than as light. Fluorescent lamps run substantially cooler, but have a substantial lag time between when they are initially turned on and when they actually start emitting light, and are often fairly bulky. Halogen lamps are highly efficient, but need to be handled very carefully and generate a considerable amount of heat when manufactured large enough to provide a usable amount of light, even when powered with low voltage (e.g. 12V).

The most recent developments in lighting technology involve the expanded use of light emitting diodes (LEDs) that are quite efficient in that they are able to convert virtually all of their supply voltage into light, thereby producing less heat and requiring less overall power consumption. In addition, LEDs may be very small and have an extremely long service life, mainly due to the fact that they operate at cooler temperatures. Compared with a traditional light bulb, an LED lamp may have a lifespan of about 50 to about 100 times that of the traditional light bulb, and the power consumption of such an LED lamp may be about one third to about one fifth that of the traditional light bulb.

General LED light sources are well known in the art. LEDs are light sources based upon a semiconductor structure, specifically a diode structure, which emit incoherent light (which may be in the ultraviolet, visible, or infrared spectrum) when electrical current is passed through the semiconductor junction. One example of such a light source may include phosphors emitting white light. The original uses of LED light sources were in low-power applications such as indicator lights on instrumentation panels and the like. However, recent developments in LED technology have increased the output power and efficiency of LED sources so that it is now feasible for them to be utilized in traditional lighting applications previously reserved for incandescent, fluorescent, sodium, and known lighting technologies. Commercially available LED light sources surpassed incandescent light sources in terms of efficiency in or around 2002. More recently, commercially available LED light sources have exceeded fluorescent light sources in efficiency. Fluorescent light sources typically exhibit around 100 lumens per Watt (lm/W) efficiency; however LED light sources recently introduced into the market exhibit 130 lm/W efficiency, and there are other LED light sources available and currently under development which exhibit even greater efficiency. Since LEDs have the foregoing advantages, the LED lamp is expected to replace current conventional light bulb technology in the 21st century and become a new light source for illumination while concurrently providing other power-saving and environmentally friendly advantages.

One current drawback with such LED lamps is that when used to replace a conventional incandescent bulb they must have special driving circuits that convert the incoming alternating-current line voltage to the direct-current low voltage needed by the lamp. Such a circuit is normally a small printed-circuit board that is permanently mounted right in the lamp and to which the LED is normally directly soldered. These circuits typically incorporate a transformer to step down the incoming voltage and a rectifier and similar power-supply elements that produce the necessary steady low voltage.

The problem with such a construction is that the driving circuit itself generates heat, particularly when the LED requires some meaningful amperage, albeit at low voltage. Above a temperature of about 25 degrees Celsius, an LED operates less efficiently and produces less light than at lower temperatures. In particular, as the operating temperature progressively increases above 25 degrees Celsius, the light output of the LED progressively decreases. Since the LED itself is typically carried right on the circuit board, when the circuit elements heat up, the LED is heated. Unfortunately the efficiency of an LED falls off rapidly as it gets hot, and thus known LED lamps tend to dim somewhat after they have been in use for a while and their driving circuits have gotten warm. Such a limited conventional design is depicted in FIG. 1, wherein a general light emitting diode 10 integrates several light emitting diodes 20 sealed by a glass cover body 30, which has difficulty in dispersing the heat generated by the light emitting diode 20 during light emission. Such light emitting LED lamps cannot typically operate under normal conditions and tend to have high failure rates.

As the output power of the commercially available LED light sources continues to improve, it has become necessary to develop methodologies and structures for removing the heat generated by the LED from the LED semiconductor junction. Typical problems caused by heating of the semiconductor junction and surrounding structure are: 1) failures brought on by such occurrences as non-homogenous distribution of the current density over the junction ("current crowding"), which causes a local hot spot in the diode junction leading to early failure due to thermal runaway; 2) nucleation and growth of dislocations in the active region of the diode in which the radiative recombination occurs due to the existence of an existing defect in the semiconductor crystalline structure and which is accelerated by heat; 3) degradation of materials utilized in the LED, such as phosphor, causing loss of efficiency and changes in output color; and 4) electromigration of metal atoms at the metallization layers of the diode causing growth of conductive "whiskers" and early failure. This is not a complete list of the undesired effects brought on by elevated temperatures; it is provided herein simply as a list of exemplary effects.

In order to manage heat, the prior art has attempted to utilize a variety of heat dissipation techniques, such as the incorporation of heat sinks, heat pipes, fans, water flow, and the like. An LED may be attached to a heat sink via heat conductive adhesive, but if the LED stops working, then the entire component must be discarded, making parts replacement costly. Such LEDs are not exchangeable or serviceable and are therefore rendered disposable and very inefficient.

Attempts have been made to provide structures for removing heat from the semiconductor junction of LED lamps. See, for example, U.S. Pat. No. 7,226,189 (wherein heat produced is conducted to a heat dissipating device through a metal substrate and then conducted from the heat dissipating device to the light bulb base in an attempt to effectively disperse the heat via structures within the light bulb); U.S. Pat. Appl. No. 2006/0050514 (wherein the base of a bulb is a passive heat sink fittable into a socket); and U.S. Pat. Appl. No. 2006/0061997 (wherein an LED is clamped to a heat sink to permit the LED to be removable and replaceable, thereby making a serviceable LED assembly with an exchangeable LED). The inventions of U.S. Pat. No. 7,226,189 and U.S. Pat. Appl. No. 2006/0050514 are directed at attempts to better conduct heat away from an LED semiconductor junction within an LED lamp via incorporation of heat conductive material within the LED lamp, however, neither reference discloses a means or additional structure to dissipate heat from the socket of the disclosed LED lamps. U.S. Pat. Appl. No. 2006/0050514 discloses a means of clamping an LED circuit board to a heat sink but fails to disclose a heat sink independent from an optics module, wherein the optics module contains the driving circuit and a plurality of LEDs therein.

Further consideration must be made in that it is typically necessary for an LED light source to contain some circuitry that will take standard household electrical power and convert it to a voltage and/or waveform that is suitable to drive one or more LEDs. Consequently, a relevant design consideration may be beneficially included to allow for packaging of such circuitry within the LED light source or removable optics module.

It may be advantageous if the LED lamp has the size and shape of a standard light bulb, including a standard base such as the type of base commonly known as a medium Edison base. However, due to spatial and thermal considerations, many manufacturers have placed the circuitry at a variety of different location, where such designs may alter the size and/or shape of the lamp so that the size and/or shape differ from that of a standard light bulb. For example, the bulb may have a special cylindrical section that is offset from the base and therein contain the circuitry.

It is also a further desirable consideration to operate the present inventive illumination apparatus and other similar devices at as close to room temperature as possible. A heat conducting element and/or a heat dissipating element may therefore preferably be deployed in such an apparatus in order to remove heat from the LED in an effort to operate the LED as close to room temperature as practicable.

It is therefore desirable that modern light sources should make use of the currently available LED technology due to the significant benefits that such light sources provide including extremely long life, the ability to control output power and spectrum, and a significant reduction in the amount of electrical energy consumed for equivalent light output power. It is also desirable that such light sources be fabricated from materials that are inexpensive and preferably comprise re-usable, recyclable, or replaceable components so as to require a minimum of new raw material and thus preserve limited natural resources. However, utilizing LED light sources in modern light sources gives rise to the significant challenge of removing the heat from the LED semiconductor junction and surrounding structures. It is therefore desirable, and not currently known in the art, for an illumination apparatus to comprise an optics module containing a integral heat conducting element and an independent heat dissipating element, preferably wherein the integral heat conducting element is a component of an optics module that may be serviced and/or replaced separate and independent from the heat dissipating element so as to be environmentally friendly and lower overall maintenance and/or replacement costs for such present inventive illumination apparatus.

BRIEF SUMMARY OF THE INVENTION

The present invention solves the afore-mentioned problems in the art by providing an optics module having a pendant body composed of heat conductive material in combination with disposing a driving circuit within the proximal base portion of the optics module. In one such embodiment, the driving circuit may be disposed within a male threaded base at the proximal end of the optics module. Such a location of the driving circuit provides for protection of the driving circuit as well as facilitating the conduction of heat generated by the driving circuit to an independent heat dissipating element. In one embodiment, the heat dissipating element may comprise a heat sink independent of the optics module, into which the optics module may be releasably secured.

In such a manner, heat may be conducted away from the light source (in the case of a LED light, the heat is conducted away from the semiconductor junction) and transferred from the optics module to a heat dissipating element. Such a structure allows for the service and/or replacement of the optics module (comprising the light emitting diodes and driving circuit) independent of the heat dissipating element (e.g. heat sink) to which the optics module is releasably secured. In accordance with an embodiment of the present invention, recycled aluminum may comprise such thermally conductive and dissipative structures allowing for the use of high efficiency LEDs in illumination apparatus, thus providing for re-use of materials and further resulting in a reduced burden on our limited natural resources. Furthermore, the removable optics module allows for replacement of such a component at the end of its lifespan completely independent of the heat dissipating element, thereby conserving resources and replacement costs throughout the life cycle of such an illumination apparatus.

The present invention need not be limited to LED light sources or the use of recycled aluminum as the structural material; any other light sources and/or thermally conductive materials may be used in alternate embodiments such as but not limited to laser diodes, incandescent light sources, fluorescent light sources, and alternate thermally conductive materials known in the art.

In at least one embodiment, the present invention may provide for an illumination apparatus comprising, an optics module comprising; a pendant body, wherein the pendant body comprises a proximal base portion and a distal projection element, a plurality of light emitting diodes disposed on the projection element of the pendant body, a lens cover disposed on the pendant body and encapsulating the plurality of light emitting diodes and the projection element, a driving circuit disposed within the base portion of the pendant body, the base portion defining a cavity in which the driving circuit is disposed, wherein the driving circuit is in electrical communication with the plurality of light emitting diodes, and a first electrical connector disposed on the proximal surface of the base portion, wherein the first electrical connector is in electrical communication with the driving circuit.

A further embodiment of the present invention may additionally comprise a heat dissipating element comprising a releasable connection to the base portion of the pendant body, wherein the heat dissipating element is reusable and the releasable connection allows for service or replacement of the optics module independent from the heat dissipating element.

BRIEF DESCRIPTION OF THE DRAWINGS

A better understanding of the present invention will be realized from the detailed description that follows, taken in conjunction with the accompanying drawings, in which.

DETAILED DESCRIPTION OF THE INVENTION

Figure 1:
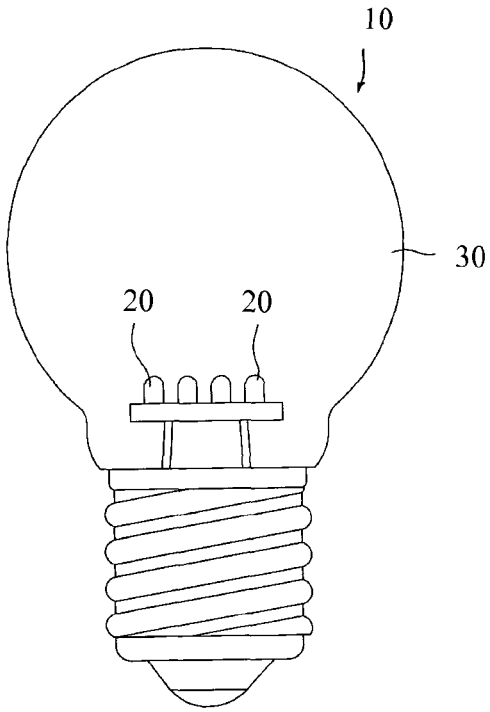
Fig. 1 Prior Art
FIG. 1 depicts a front view of the structure of a prior art light emitting diode bulb.
Figure 2A:
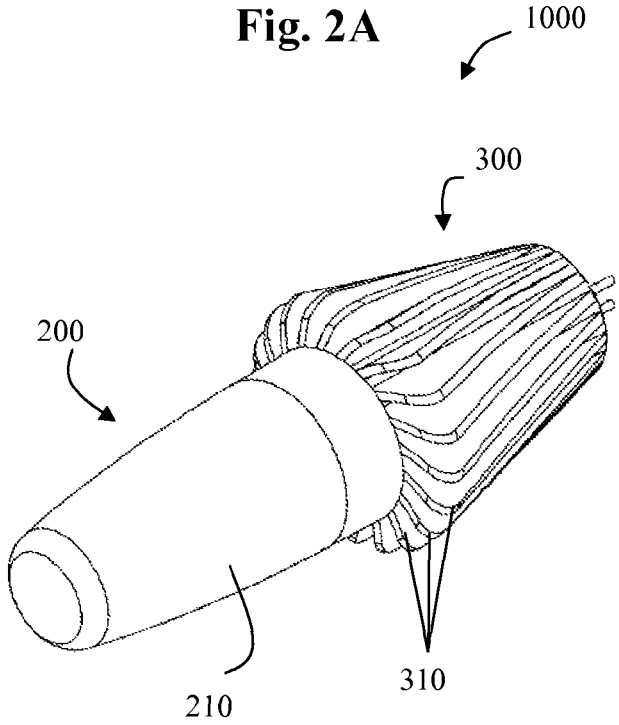
FIG. 2A depicts a distal perspective view of an embodiment of an illumination apparatus of the present invention.
Figure 2B:
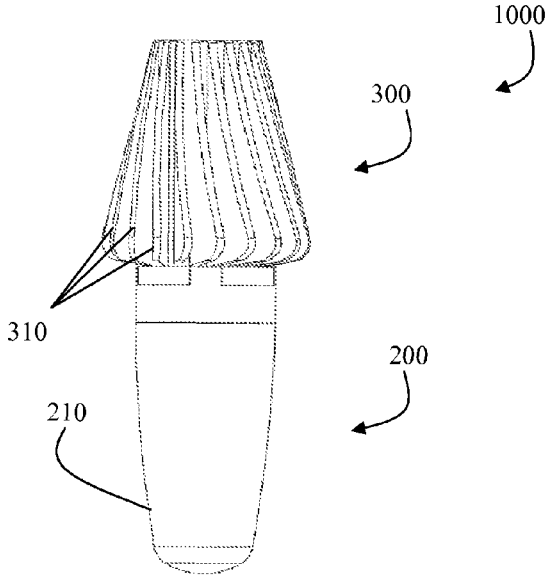
FIG. 2B depicts a side view of an embodiment of an illumination apparatus of the present invention.
Figure 2C:
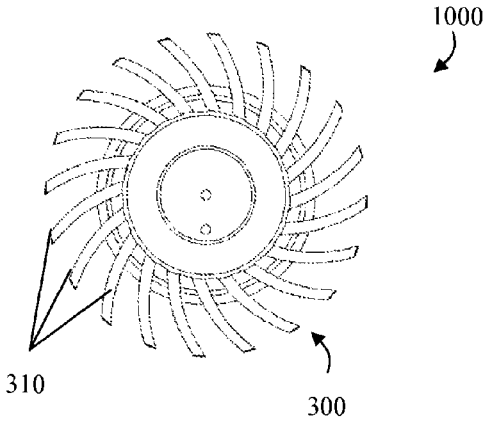
FIG. 2C depicts a proximal plan view of an embodiment of an illumination apparatus of the present invention.
Figure 2D:
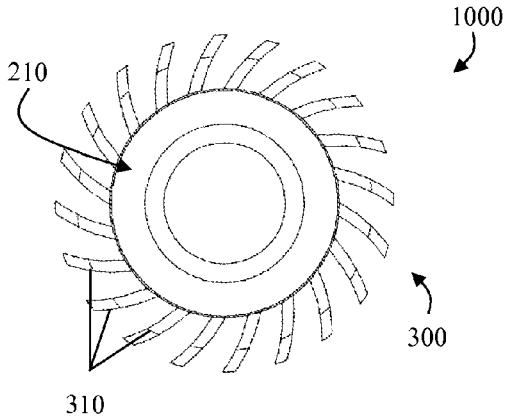
FIG. 2D depicts a distal plan view of an embodiment of an illumination apparatus of the present invention.

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

One embodiment of the present inventive illumination apparatus 1000 is illustrated in FIGS. 2A-2D. As shown in FIGS. 2A-2D, the illumination apparatus 1000 may generally comprise an optics module 200 that may be releasably secured to a heat dissipating element 300 via a releasable connection. As further depicted, the heat dissipating element 300 may comprise a plurality of radially projecting fins 310. The Figures also illustrate a lens cover 210 which may encapsulate and enclose other functional components of the optics module 200 there under.

The illumination apparatus 1000 of the present invention provides a long lasting, energy efficient light source. Additionally, the releasable connection between the optics module 200 and the heat dissipating element 300 allows for service and replacement of an optics module 200 as necessary, while the independent heat dissipating element 300 may remain behind and be re-used with a new or repaired optics module 200. By separating the optics module 200 and heat dissipating element 300, the user may conserve resources and replacement costs throughout the life cycle of such an illumination apparatus 1000 since the original heat dissipating element 300 may be continuously re-used.

FIGS. 3A-3F depict a variety of views of an embodiment of an optics module 200 of the present invention. The foundation of the optics module 200 may comprise a proximal base portion 230 and a distal projection element 240 encapsulated by a lens cover 210. The manner in which the lens cover 210 is attached to the pendant body 220 is not critical to the present invention and may comprise any means known in the art including but not limited to a friction fit, snap fit, threading, adhesive, bonding, and the like. The elements of the optics module 200 disposed beneath the lens cover 210 are better illustrated in the cross-sectional view provided in FIG. 3D. The projection element 240 may comprise any shape or configuration known within the art, and in a preferred embodiment the projection element 240 may comprise a triangular cross section, as shown in FIGS. 4A-4B. A plurality of light emitting diodes (LEDs) 250 may be disposed about the surface of the projection element 240. The manner of attaching the plurality of LEDs 250 to the projection element 240 is not critical to the present invention and any such methods or structures known within the art may be used including but not limited to mechanical means, chemical means, and the like. In a preferred embodiment, the plurality of LEDs 250 may comprise three independent planar light emitting modules (see FIGS. 4A-4B). The lens cover 210 may then encapsulate and protect the light emitting components of the optics module 200 disposed there below.

The base portion 230 of the optics module 200 may comprise a releasable connection at the proximal end of the optics module 200 for securing the optics module 200 to the heat dissipating element 300. The releasable connection may include but is not limited to a threaded connection (as shown throughout FIGS. 3A-6), a friction fit connection, a post and groove connection, or any other light fixture connections known within the art. Additionally, the base portion 230 may be comprised of thermally conductive material to assist in conducting heat away from the driving circuit, as discussed below.

Figure 3A:
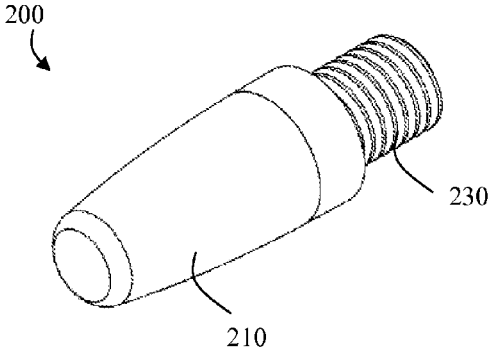
FIG. 3A depicts a distal perspective view of an embodiment of an optics module of the present invention.
Figure 3B:
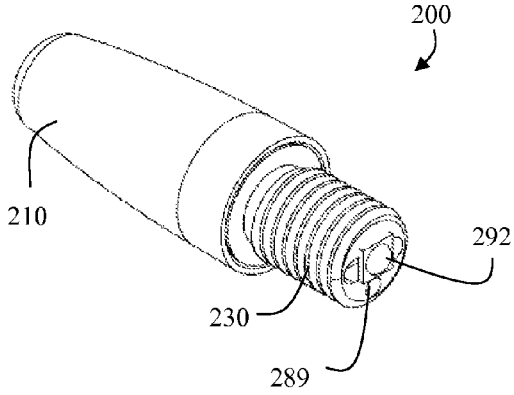
FIG. 3B depicts a proximal perspective view of an embodiment of an optics module of the present invention.
Figure 3C:
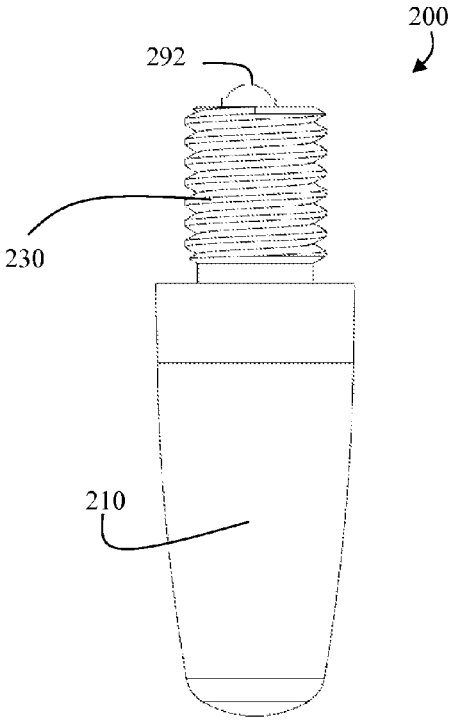
FIG. 3C depicts a side view of an embodiment of an optics module of the present invention.
Figure 3D:
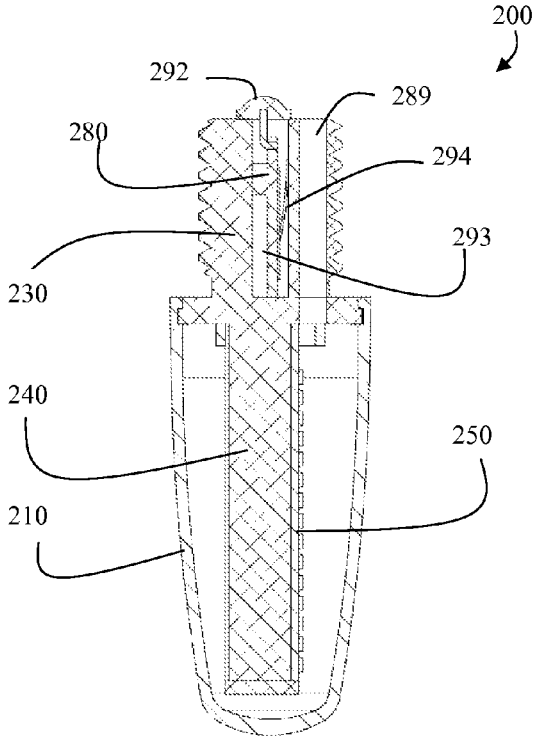
FIG. 3D depicts a diagrammatic cross-sectional view of the optics module of FIG. 3C along its central axis.
Figure 3E:
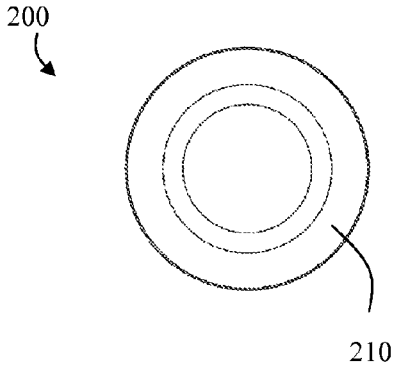
FIG. 3E depicts a distal plan view of an optics module of the present invention.
Figure 3F:
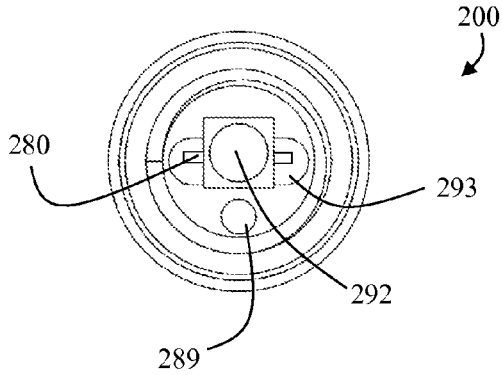
FIG. 3F depicts a proximal plan view of an optics module of the present invention.
Figure 4A:
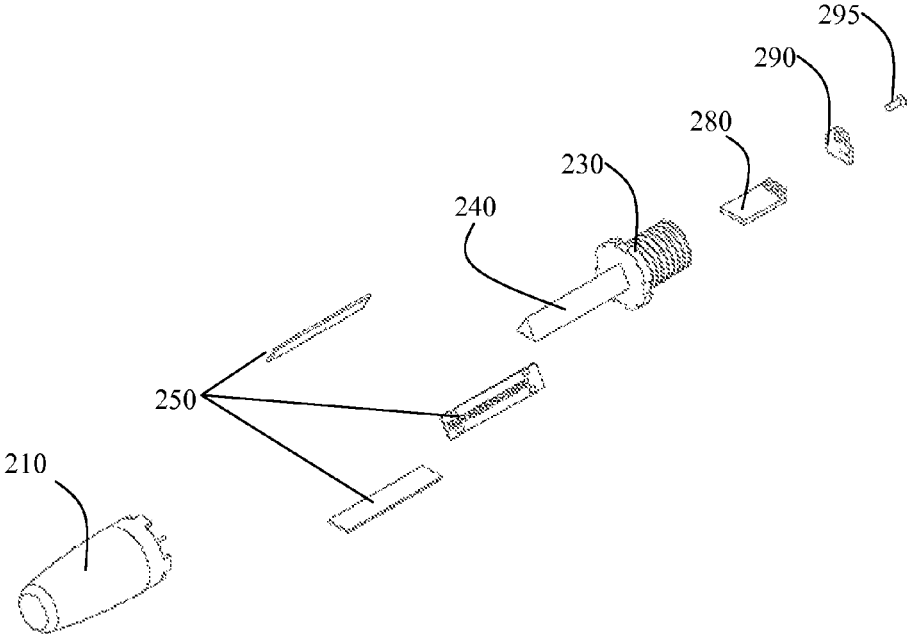
FIG. 4A depicts a diagrammatic exploded distal perspective view of an embodiment of an optics module of the present invention.
Figure 4B:
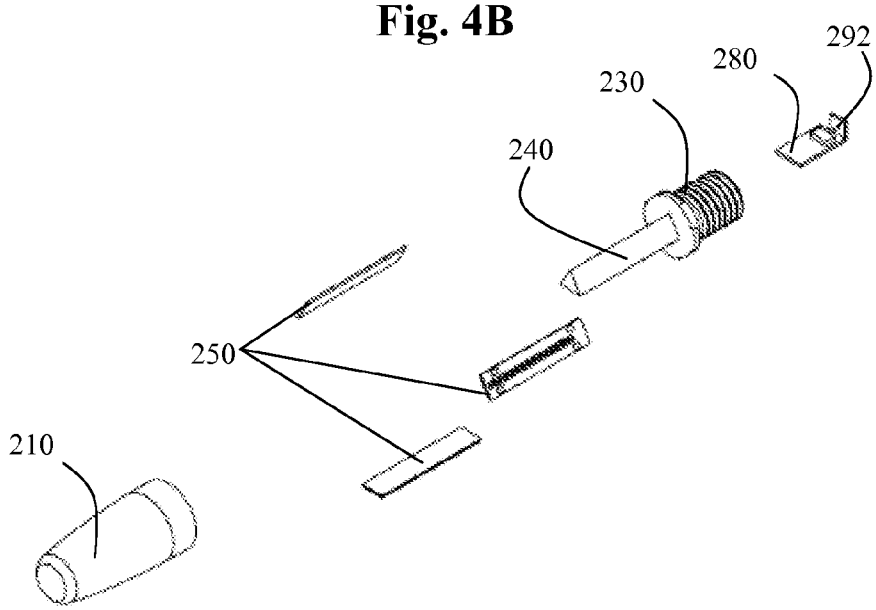
FIG. 4B depicts a diagrammatic exploded distal perspective view of another embodiment of an optics module of the present invention.

As shown in FIGS. 3B, 3D, and 3F, the base portion 230 may define a cavity 293 accessible through the proximal surface of the base portion 230 wherein a driving circuit 280 may be disposed. A retention member 294, as seen in FIG. 3D, may be incorporated to assist in maintaining the driving circuit 280 within the cavity 293. The retention member 294 is not essential to the invention and may comprise any such structures known within the art including but not limited to a leaf spring (as shown) and the like. A first electrical connector 292 may be disposed on the proximal surface of the base portion 230, wherein the first electrical connector 292 is in electrical communication with the driving circuit 280. FIGS. 3B, 3D, and 3F depict the first electrical connector as a button style connector, however, within the scope of the present invention the first electrical connector 292 may comprise any connector type known within the art including but not limited to a button style electrical connector, a leaf spring electrical connector, a coil spring electrical connector, and the like. The first electrical connector 292 may be disposed across the opening of the cavity 293 to assist in forming the electrical connection with the driving circuit 280 and to further assist in physically maintaining the driving circuit 280 within the cavity 293. However, such a position of the first electrical connector 292 is not essential and a retention member 294 may be used alone to maintain the driving circuit 280 within the cavity 293 if the first electrical connector 292 is not disposed across the mouth of the cavity 293.

A channel 289, as shown in FIGS. 3B, 3D, and 3F, may be defined by the base portion 230 of the pendant body 220 and such a channel 289 may extend from the distal surface of the base portion 230 to the proximal surface of the base portion 230. The channel 289 may assist in allowing the plurality of LEDs 250 to be in electrical communication with the driving circuit 280. Electrical wiring or any other manner of electrical connection known within the art may be used to connect the plurality of LEDs 250 to the driving circuit 280. In a preferred embodiment, electrical wiring or any other manner of establishing an electrical connection known within the art may connect with the plurality of LEDs 250, pass from the distal surface of the base portion 230 through the channel 289 to the proximal surface of the base portion 230, enter the mouth of the cavity 293, and then be electrically connected to the driving circuit 280.

As depicted in FIG. 4A, the optics module 200 may further comprise a first contact board 290 that may be disposed on the proximal surface of the base portion 230 and may further serve to protect and maintain the driving circuit 280 within the cavity 293. When a first contact board 290 is used, the first electrical connector 292 may be disposed upon the first contact board 290 wherein the first electrical connector 292 remains in electrical communication with the driving circuit 280. The contact board 290 may be secured in place immediately adjacent the proximal surface of the base portion 230 via at least one fastener member 295.

The at least one fastener member 295 may comprise any means of contact board 290 fixation known within the art including but not limited to a screw, a rivet, an adhesive, a bonding material, and the like. In the embodiment shown in FIG. 4A, the at least one fastener member 295 is depicted as a threaded screw passing through the first contact board 290 and being secured into the proximal surface of the base portion 230. In an alternative embodiment, as shown in FIG. 4B, the driving circuit 280 may be integral with the first electrical connector 292 disposed thereon and may further include alternate embodiments with or without a first contact board 290 on which the first electrical connector 292 may be disposed.

Figure 5A:
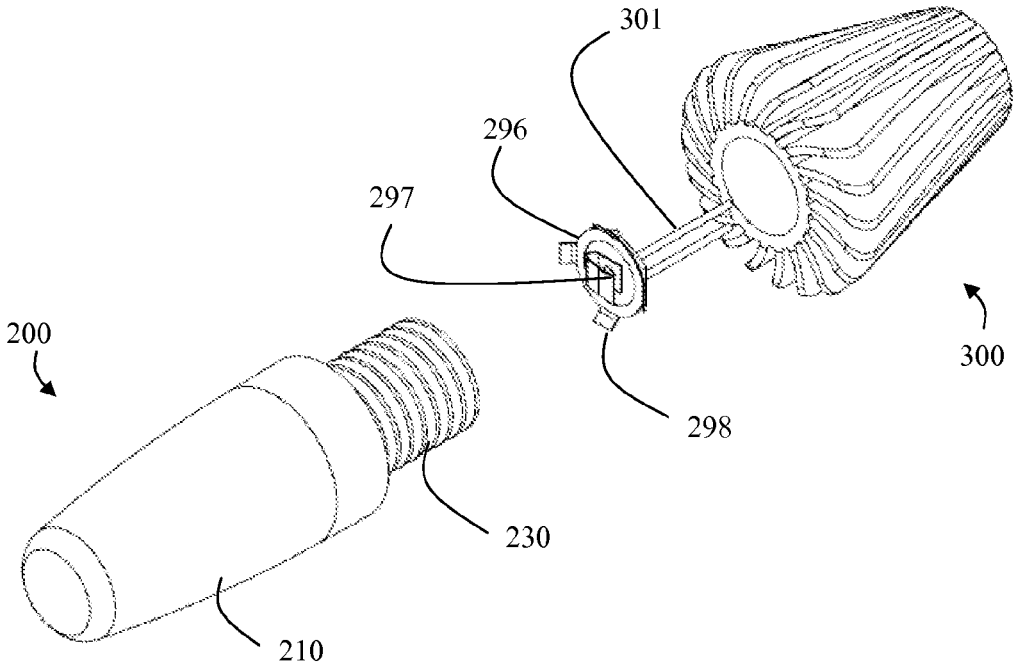
FIG. 5A depicts a diagrammatic exploded distal perspective view of an embodiment of an illumination apparatus of the present invention.

FIG. 5A depicts an illumination apparatus 1000 of the present invention, wherein a first embodiment of the heat dissipating element 300 is shown. The heat dissipating element 300 may primarily function to transport heat away from the optics module 200 and may also serve to provide the illumination apparatus 1000 with an electrical connection to an outside power source. To provide an electrical connection, the heat dissipating element 300 may comprise a second contact board 296 on which a second electrical connector 297 may be disposed. FIG. 5A illustrates the second electrical connector 297 as a spring style connector. However, within the scope of the present invention the second electrical connector 297 may comprise any connector type known within the art including but not limited to a button style electrical connector, a leaf spring electrical connector, a coil spring electrical connector, and the like. When the releasable connection is fully established between the optics module 200 and the heat dissipating element 300, the first electrical connector 292 of the optics module 200 will be in both physical and electrical communication with the second electrical connector 297 of the heat dissipating element 300.

The second contact board 296 may further comprise at least one fixation element 298. The at least one fixation element 298 may assist in physically maintaining the second contact board 296 within the heat dissipating element 300 and may also provide a ground for the circuit to the heat dissipating element 300. FIG. 5A depicts the at least one fixation element 298 as four tabs extending from the second contact board 296. In one such embodiment, as the male threading about the base portion 230 is screwed into the female threading within the heat dissipating element 300, the second contact board 296 may be disposed therebetween and be driven deeper within the heat dissipating element 300 with the four tab fixation elements 298 retaining the second contact board 296 therein. The four tab fixation elements 298, being in physical communication with the heat dissipating element 300 may further serve to provide a ground for the electrical circuit.

Figure 5B:
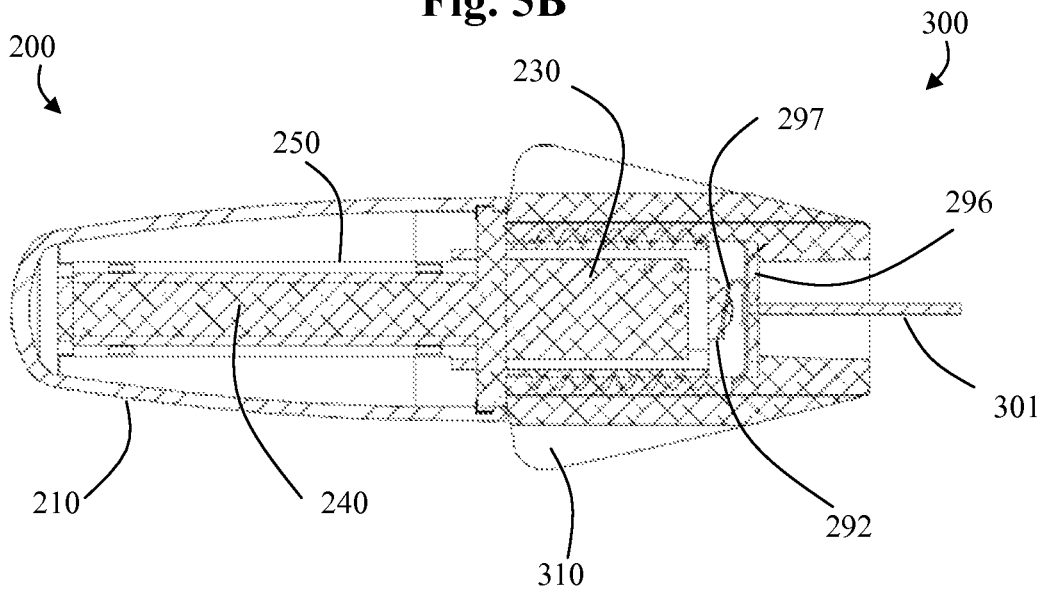
FIG. 5B depicts a diagrammatic cross-sectional view of the illumination apparatus of FIG. 5A along its central axis.

FIG. 5B depicts a cross-sectional view of the embodiment of FIG. 5A. When the releasable connection between the optics module 200 and the heat dissipating element 300 is established, the second contact board 296 may be compressed within the heat dissipating element 300. In this position, as shown, the first electrical connector 292 (button style contact) is in physical and electrical communication with the second electrical connector 297 (spring style contact). An external electrical connector 301 may provide an electrical connection to a power source external to the illumination apparatus 1000. The external electrical connector 301 may comprise any form of connector known within the art including but not limited to one or more terminals (as shown in FIGS. 5A-5B), a wiring connection that may be soldered, bonded, adhered, or mechanically fastened in position, and the like.

Figure 6:
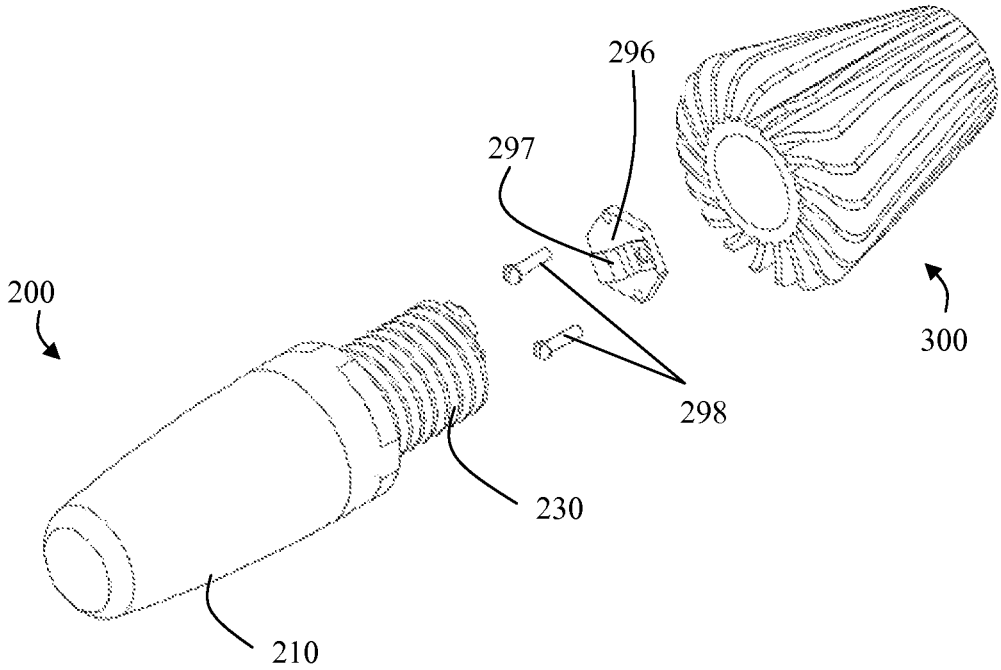
FIG. 6 depicts a diagrammatic exploded distal perspective view of an embodiment of an illumination apparatus of the present invention.

FIG. 6 illustrates an embodiment of the illumination apparatus 1000 of the present invention wherein the at least one fixation element 298 comprises two mechanical fasteners used to secure the second contact board 296 within the heat dissipating element 300. The at least one fixation element 298 may comprise any form of fixation known within the art including but not limited to friction fit tabs (see FIG. 5A), mechanical fasteners such as screws or rivets (see FIG. 6), chemical fasteners such as epoxies, adhesives and other bonds, and the like. A fixation element 298 having conductive properties may also serve as a ground for the electrical circuit to the heat dissipating element 300.

The heat dissipating element 300 may comprise a variety of configurations. The plurality of radially projecting fins 310 may be curved (as shown in FIGS. 2A-2C and 5), straight, or any other heat dissipating configurations known within the art. The heat dissipating element 300 may further comprise a releasable connection with the optics module 200, thereby allowing for removal of the optics module 200 from the heat dissipating element 300 when maintenance, repair and/or replacement are required. The releasable connection may include but is not limited to a threaded connection (as shown in FIGS. 5A-6), a friction fit connection, and any other light fixture connections known within the art. The heat dissipating element 300 and the pendant body 220 may preferably be composed of extruded aluminum or copper. However, both the heat dissipating element 300 and the pendant body 220 may alternatively and respectively be made of any other suitable material or materials that are thermally conductive, and any combinations thereof.

In use within a preferred embodiment, as best shown in FIGS. 3D and 5B, the optics module 200 may have a releasable physical connection with the heat dissipating element 300 via complimentary male/female threading or any other such connection known within the art. With the primary heat dissipating element 300 being disposed external to the optics module 200, the optics module 200 may be replaced or repaired independent of the heat dissipating element 300 via such a releasable connection. As shown in FIG. 3D, the light source, such as a plurality of LEDs 250, may be disposed on the projection element 240 of the pendant body 220. Wiring or any other form of electrical connection known within the art may then pass through a channel 289 disposed within the base portion 230 of the pendant body 220 extending from the distal surface of the base portion 230 to the proximal surface of the base portion 230. The wiring or other electrical connection may then enter the mouth of a cavity 293 on the proximal surface of the base portion 230. Within the cavity 293, the wiring or other electrical connection may form an electrical connection with the driving circuit 280 disposed therein. The driving circuit 280 may then be in electrical communication with the first electrical connector 292 disposed on the proximal surface of the base portion 230. When the releasable connection between the optics module 200 and the heat dissipating element 300 is fully established, as shown in FIG. 5B, the first electrical connector 292 of the optics module 200 may be in both physical and electrical communication with the second electrical connector 297 disposed on the second contact board 296 of the heat dissipating element 300. The second contact board 296 may further comprise at least one fixation element 298 to physically maintain the second contact board 296 within the heat dissipating element 300, and may further provide a means for grounding the circuit to the heat dissipating element 300. The second electrical connector 297 may then be in electrical communication with an external electrical connector 301, thereby connecting the illumination apparatus 1000 to an external power source.

The present invention makes use of the currently available LED technology due to the significant benefits that such light sources provide including extremely long life, the ability to control output power and spectrum, and a significant reduction in the amount of electrical energy consumed for equivalent light output power. Many of the structures of the illumination apparatus may be fabricated from materials that are inexpensive and preferably comprise re-usable, recyclable, or replaceable components so as to require a minimum of new raw material and thus preserve limited natural resources. The illumination apparatus may further comprise an optics module containing a integral heat conducting element and an independent heat dissipating element, preferably wherein the integral heat conducting element is a component of an optics module that may be serviced and/or replaced separate and independent from the heat dissipating element so as to be environmentally friendly and lower overall maintenance and/or replacement costs for such inventive illumination apparatus.

While the above description contains much specificity, these should not be construed as limitations on the scope of any embodiment, but as exemplifications of the presently preferred embodiments thereof. Many other ramifications and variations are possible within the teachings of the various embodiments.

Thus the scope of the invention should be determined by the appended claims and their legal equivalents, and not by the examples given.

What is claimed is:

1. An illumination apparatus, said illumination apparatus comprising:

an optics module comprising:

a pendant body, wherein said pendant body comprises a proximal base portion and a distal projection element;

a plurality of light emitting diodes disposed on said projection element of said pendant body;

a lens cover disposed on said pendant body and encapsulating said plurality of light emitting diodes and said projection element;

a driving circuit disposed within said base portion of said pendant body, said base portion defining a cavity in which said driving circuit is disposed, wherein said driving circuit is in electrical communication with said plurality of light emitting diodes;

a first electrical connector disposed on the proximal surface of said base portion, wherein said first electrical connector is in electrical communication with said driving circuit; and a first contact board disposed on said proximal surface of said base portion, whereon said first electrical connector is disposed on said first contact board.

2. The illumination apparatus of claim 1, wherein said optics module further comprises:

at least one fastener for securing said first contact board to said proximal surface of said base portion of said pendant body.

3. An illumination apparatus, said illumination apparatus comprising:

an optics module comprising:

a pendant body wherein said pendant body comprises a proximal base portion and a distal projection element;

a plurality of light emitting diodes disposed on said projection element of said pendant body;

a lens cover disposed on said pendant body and encapsulating said plurality of light emitting diodes and said projection element;

a driving circuit disposed within said base portion of said pendant body, said base portion defining a cavity in which said driving circuit is disposed, wherein said driving circuit is in electrical communication with said plurality of light emitting diodes; and a first electrical connector disposed on the proximal surface of said base portion, wherein said first electrical connector is in electrical communication with said driving circuit; and a heat dissipating element comprising a releasable connection to said base portion of said pendant body, wherein said heat dissipating element is reusable and said releasable connection allows for service or replacement of said optics module independent from said heat dissipating element.

4. The illumination apparatus of claim 3, wherein said base portion further comprises a channel extending from the distal surface of said base portion to said proximal surface of said base portion through which said driving circuit is in electrical communication with said plurality of light emitting diodes.

5. The illumination apparatus of claim 3, wherein said first electrical connector is selected from the group consisting of a button style electrical connector, a leaf spring electrical connector, and a coil spring electrical connector.

6. The illumination apparatus of claim 3, wherein said projection element of said pendant body comprises a triangular cross section.

7. The illumination apparatus of claim 3, wherein said plurality of light emitting diodes comprises three independent planar light emitting diode modules disposed on said projection element of said pendant body.

8. The illumination apparatus of claim 3, wherein said releasable connection is selected from the group consisting of a threaded connection, a friction fit connection, and a post and groove connection between said heat dissipating element and said base portion of said pendant body.

9. The illumination apparatus of claim 3, wherein said heat dissipating element comprises a plurality of radially projecting fins.

10. The illumination apparatus of claim 3, wherein said heat dissipating element further comprises a second contact board having a second electrical connector disposed on said second contact board, wherein when said releasable connection is established said second electrical connector of said heat dissipating element is in physical and electrical communication with said first electrical connector of said optics module.

11. The illumination apparatus of claim 10, wherein said second electrical connector is selected from the group consisting of a button style electrical connector, a leaf spring electrical connector, and a coil spring electrical connector.

12. The illumination apparatus of claim 10, wherein said second contact board is attached to said heat dissipating element via at least one fixation element.

13. The illumination apparatus of claim 12, wherein said at least one fixation element is selected from the group consisting of at least one tab, at least one screw, at least one rivet, a threaded periphery, adhesive, and bonding.

14. An illumination apparatus, said illumination apparatus comprising:

an optics module comprising:

a pendant body, wherein said pendant body comprises a proximal base portion and a distal projection element;

a plurality of light emitting diodes disposed on said projection element of said pendant body;

a lens cover disposed on said pendant body and encapsulating said plurality of light emitting diodes and said projection element;

a driving circuit disposed within said base portion of said pendant body, said base portion defining a cavity in which said driving circuit is disposed, wherein said driving circuit is in electrical communication with said plurality of light emitting diodes; and a first electrical connector disposed on the proximal surface of said base portion, wherein said first electrical connector is in electrical communication with said driving circuit;

wherein said base portion further comprises a channel extending from the distal surface of said base portion to said proximal surface of said base portion through which said driving circuit is in electrical communication with said plurality of light emitting diodes; and a heat dissipating element comprising:

a releasable connection to said base portion of said pendant body, wherein said heat dissipating element is reusable and said releasable connection allows for service or replacement of said optics module independent from said heat dissipating element; and a second contact board having a second electrical connector disposed on said second contact board, wherein when said releasable connection is established said second electrical connector of said heat dissipating element is in physical and electrical communication with said first electrical connector of said optics module.

15. The illumination apparatus of claim 14, wherein said first electrical connector and said second electrical connector are independently selected from the group consisting of a button style electrical connector, a leaf spring electrical connector, and a coil spring electrical connector.

16. The illumination apparatus of claim 14, wherein said second contact board is attached to said heat dissipating element via at least one fixation element.

17. The illumination apparatus of claim 14, wherein said optics module further comprises:

a first contact board disposed on said proximal surface of said base portion upon which said first electrical connector is disposed.

18. The illumination apparatus of claim 14, wherein said releasable connection is selected from the group consisting of a threaded connection, a friction fit connection, and a post and groove connection between said heat dissipating element and said base portion of said pendant body.

19. An illumination apparatus, said illumination apparatus comprising:

an optics module comprising:

a pendant body, wherein said pendant body comprises a proximal base portion and a distal projection element;

a plurality of light emitting diodes disposed on said projection element of said pendant body;

a lens cover disposed on said pendant body and encapsulating said plurality of light emitting diodes and said projection element;

a driving circuit disposed within said base portion of said pendant body, said base portion defining a cavity in which said driving circuit is disposed, wherein said driving circuit is in electrical communication with said plurality of light emitting diodes; and a first electrical connector disposed on the proximal surface of said base portion, wherein said first electrical connector is in electrical communication with said driving circuit;

wherein said base portion further comprises a channel extending from the distal surface of said base portion to said proximal surface of said base portion through which said driving circuit is in electrical communication with said plurality of light emitting diodes; and a heat dissipating element comprising:

a releasable connection to said base portion of said pendant body, wherein said heat dissipating element is reusable and said releasable connection allows for service or replacement of said optics module independent from said heat dissipating element, wherein said releasable connection is selected from the group consisting of a threaded connection, a friction fit connection, and a post and groove connection between said heat dissipating element and said base portion of said pendant body; and a second contact board having a second electrical connector disposed on said second contact board, wherein said second contact board is attached to said heat dissipating element via at least one fixation element and when said releasable connection is established said second electrical connector of said heat dissipating element is in physical and electrical communication with said first electrical connector of said optics module;

wherein said first electrical connector and said second electrical connector are independently selected from the group consisting of a button style electrical connector, a leaf spring electrical connector, and a coil spring electrical connector.

* * * * *